US005458519A

United States Patent [19]

Lee et al.

[11] Patent Number: 5,458,519

[45] Date of Patent: Oct. 17, 1995

[54] PLASMA DISPLAY PANEL AND THE FABRICATION METHOD THEREOF

[75] Inventors: Seung-woo Lee; Ji-hyun Kang, both of Seoul, Rep. of Korea

[73] Assignee: Samsung Electronics Co., Ltd., Suwon, Rep. of Korea

[21] Appl. No.: 348,184

[22] Filed: Nov. 29, 1994

Related U.S. Application Data

[63] Continuation of Ser. No. 142,101, Oct. 28, 1994, abandoned, which is a continuation of Ser. No. 725,971, Jul. 3, 1991, abandoned.

[30] Foreign Application Priority Data

Jul. 3, 1990 [KR] Rep. of Korea ..... 90-10032

[51] Int. Cl.[6] ..... H01J 9/18

[52] U.S. Cl. ..... 445/24; 445/33

[58] Field of Search ..... 445/24, 33

[56] References Cited

U.S. PATENT DOCUMENTS

| | | | |
|---|---|---|---|
| 1,754,491 | 4/1930 | Wald | 313/584 X |
| 2,925,525 | 2/1960 | Davis | 313/505 X |
| 3,602,756 | 8/1971 | Bonnet | 445/24 |
| 3,611,019 | 10/1971 | Krembs | 445/24 |
| 3,767,968 | 10/1973 | Ogle | 313/584 X |
| 3,829,734 | 8/1974 | Schofield | 313/584 |
| 3,837,958 | 9/1974 | Van Esdonk et al. | 313/584 |
| 3,838,079 | 9/1974 | Masi | 313/493 X |
| 3,838,307 | 9/1974 | Masi | 313/493 X |
| 3,846,171 | 11/1974 | Byrun, Jr. et al. | 445/24 |
| 3,885,195 | 5/1975 | Amano | 313/584 X |
| 4,183,125 | 1/1980 | Meyer et al. | 445/24 |
| 4,304,450 | 12/1981 | Bilsback et al. | 445/24 |
| 4,772,820 | 9/1988 | DiSanto et al. | 313/584 |

*Primary Examiner*—Mark Rosenbaum
*Assistant Examiner*—Jeffrey T. Knapp
*Attorney, Agent, or Firm*—Charles R. Donohoe; Robert A. Westerlund, Jr.; Stephen R. Whitt

[57] ABSTRACT

The plasma display panel comprises two substrates onto which parallel cathodes and anodes are attached, respectively. When the anode and cathode substrates are connected together by barriers, which also prevent the cross-talk between pixels, the cathodes and anodes are perpendicular to each other. The cathodes are made of thin metallic wires that attach to the rear substrate. Fabricating the cathode structure comprises the steps of: preparing a compound fiber in which a plurality of metallic lines are arranged in parallel and a plurality of thermoplastic threads are arranged perpendicular to the metallic lines; placing the compound fiber on the rear substrate; and baking this combination.

8 Claims, 2 Drawing Sheets

PLASMA DISPLAY PANEL AND THE FABRICATION METHOD THEREOF

This is a continuation of application No. 08/142,101, filed on Oct. 28, 1994, which was abandoned upon the filing hereof, which was a continuation of Ser. No. 07,725,971 filed Jul. 3, 1991 now abandoned.

BACKGROUND OF THE INVENTION

The present invention relates to a plasma display panel and the fabrication method thereof, and more particularly to a plasma display panel which is very strong structurally, and has a cathode having low line resistance and high strength.

In known plasma display panels, parallel anodes A and parallel cathodes K are arranged on each inner side of a front plate 10 and a rear plate 20, respectively. Plates 10 and 20 are spaced from each other a predetermined interval using barriers B, as shown in FIG. 1. Cathodes K and anodes A are properly positioned perpendicular to each other, as in the form of an X-Y matrix. As shown, anode A is generally made of a transparent ITO thin film, because it is located on the traveling passage of the visible ray generated between a cathode K and an anode A.

The conventional plasma display panel has disadvantages. For instance, the cathode material must withstand ion shock, but forming such a cathode in a process is difficult and yield becomes very low. Also, the cathodes should be arranged very compactly to obtain a sharp image, but known layer forming techniques restrict the ability to make a more compact device. Accordingly, the line resistance of the cathodes is very high, power consumption is high, the picture quality is deteriorated, and the lifetime is shorter.

SUMMARY OF THE INVENTION

It is an object of the present invention to provide a plasma display panel that is strong in structure and has a cathode of a low line resistance and high strength.

Also, it is another object of the present invention to provide a fabrication method of a plasma display panel having the above recited advantages.

To achieve the object, a plasma display panel of the present invention comprises front and rear substrates, cathodes and anodes arranged in a predetermined location on the front and rear substrates, and barriers for preventing the cross-talk between pixels. The cathodes are made of a thin metallic lines and are attached and fixed on the rear substrate.

A method of fabricating cathodes for a plasma display panel according to the present invention comprises the steps of: attaching on a rear plate a compound fiber (fiber composite) in which a plurality of metallic cathode lines are compactly arranged in parallel and a plurality of thermoplastic threads are arranged perpendicularly to the metallic cathode lines; and baking the compound fiber to melt the thermoplastic threads, thereby completing the cathode.

Since the cathode of the plasma display panel according to the present invention is made of a metallic line, the cathode can be formed much finer than the conventional cathode. The screen pixels are thus very compact.

The plasma display panel fabrication method of the present invention is also very suitable for mass production.

BRIEF DESCRIPTION OF THE DRAWINGS

The above objects and other advantages of the present invention will become more apparent by describing the preferred embodiment of the present invention with reference to the attached drawings, in which.

DETAILED DESCRIPTION OF THE INVENTION

Figure 1:
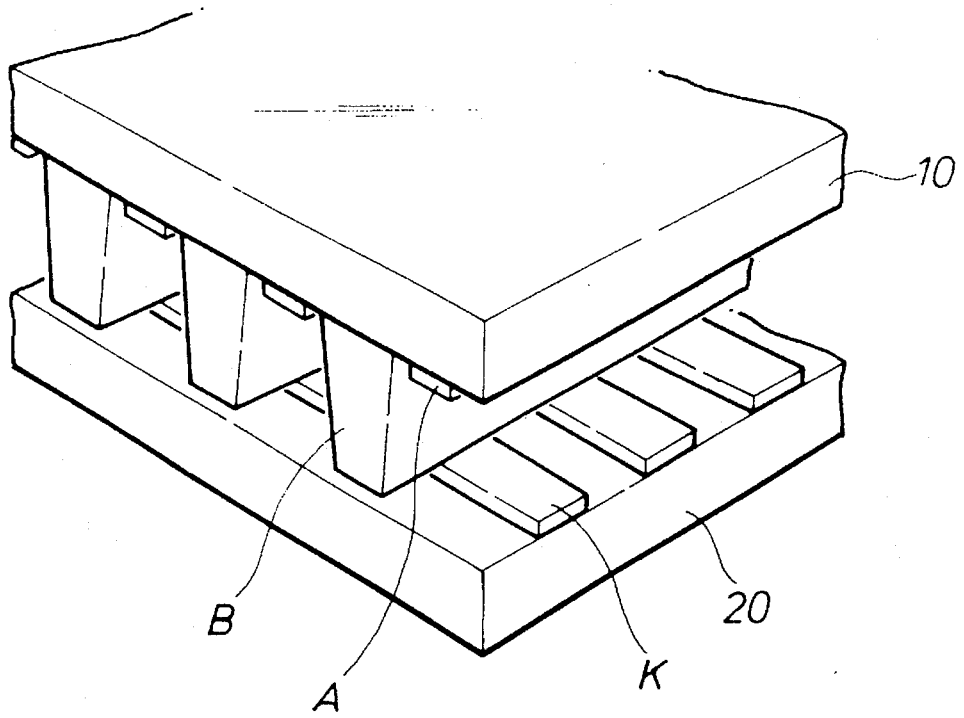
FIG. 1(PRIOR ART)
FIG. 1 is a schematic view of a conventional plasma display panel.
Figure 2:
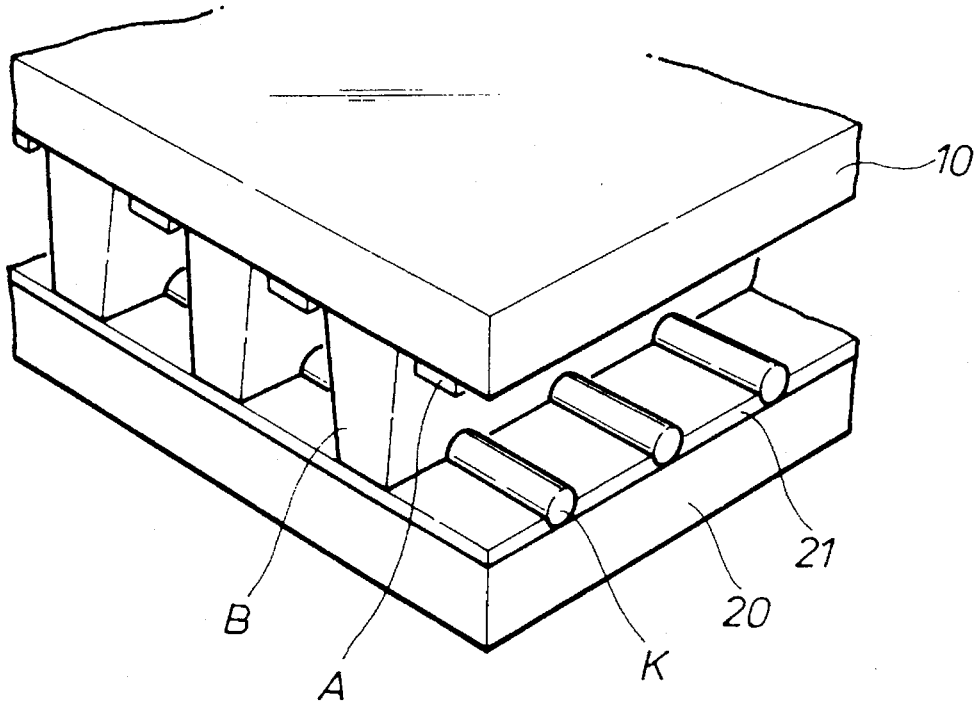
FIG. 2 is a perspective view of an embodiment of the plasma display panel of the present invention.

FIG. 2 shows a plasma display panel according to the present invention. Cathodes K and anodes A are arranged perpendicular to each other in the form of X-Y matrix on the inner surfaces of a front substrate 10 and a rear substrate 20, respectively. Substrates 10 and 20 are spaced from each other a predetermined interval, which interval is determined by the height of barriers B. Barriers B are also in spaced relation between anodes A.

The cathode K according to the present invention is made of a thin metallic line or wire which is compact and formed on an insulating layer 21, which is disposed on the inner surface of the rear substrate 20.

The cathode K in a plasma display panel of the present invention is structurally very strong due to its large cross-sectional area in all directions. This large cross-sectional area is preferably obtained with a circular cross-section as shown, although other shapes, such as hexagonal, could be used, to also result in a low line resistance. Since the number of cathodes K in a given area depends on the diameter of the metallic line, the use of a metallic wire allows the interval between cathodes to be extremely narrow. Thus, a screen having highly compact pixels can be constructed.

It is preferred that the plasma display panel of the present invention having the aforementioned structure is manufactured by the fabrication method described as follows.

Figure 3:
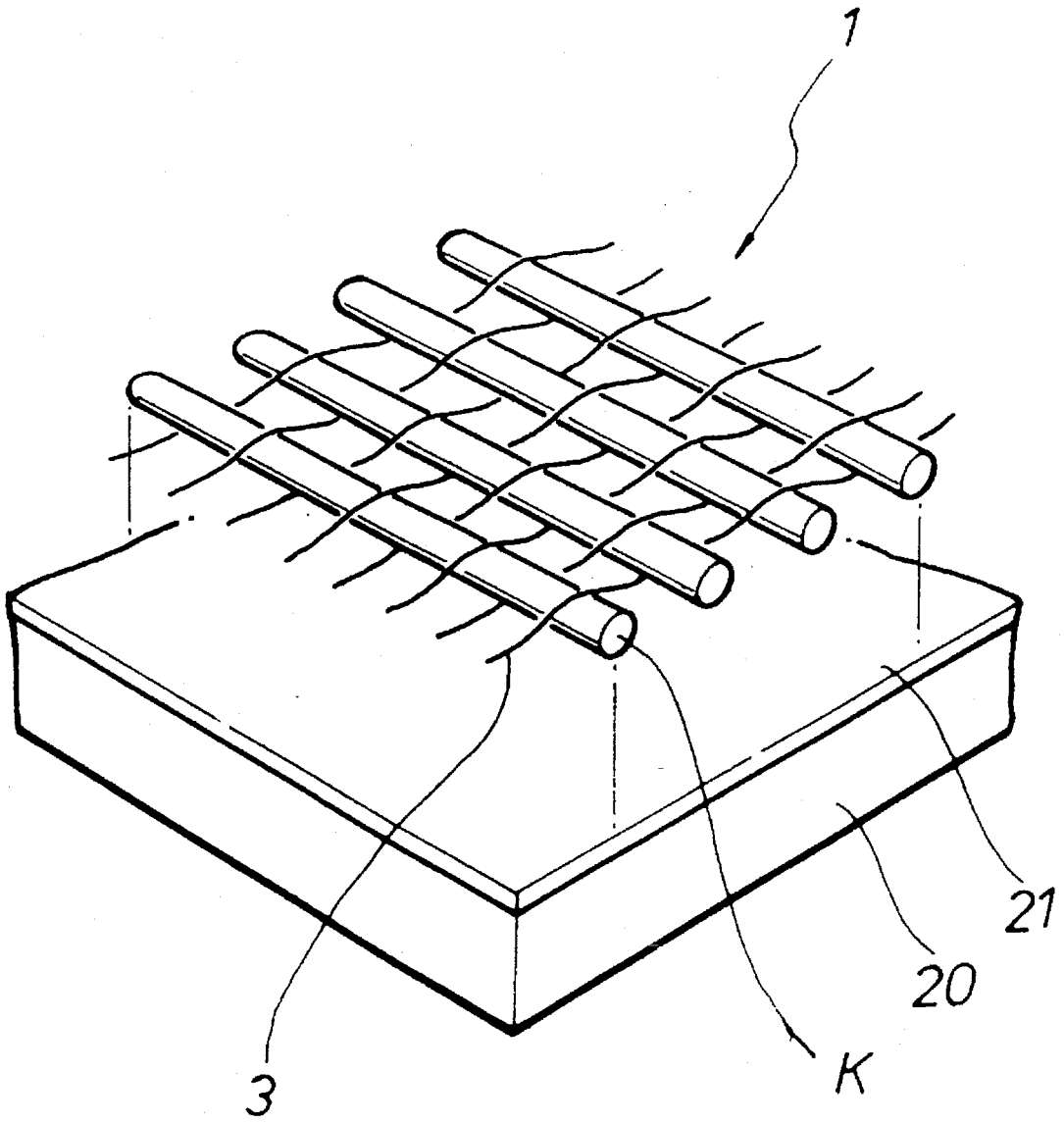
FIG. 3 is an expanded view of the compound cathode fiber for the plasma display according to the present invention.

FIG. 3 illustrates that a compound fiber comprising a plurality of warps of metallic lines are used to obtain the cathodes K. Metallic lines or wires (which make up the cathodes K) are spaced from each other a predetermined interval, and held in position by thermoplastic woofs 3. The interval between metallic lines corresponds to the desired interval between the cathodes K. The fabrication method of the cathodes K of the plasma display panel using the compound fiber is as follows.

An insulting adhesive layer 21 is first formed on the inner side of the rear substrate 20. The adhesive layer 21 has a thermal decomposition temperature higher than the woofs 3 of the compound fiber.

The compound fiber is then attached to the adhesive layer 21. The whole rear substrate is then placed in a furnace and the woofs decompose. Accordingly, the metallic lines remain as cathodes K fixed on rear substrate 20.

The anodes and barriers are formed on the front plate 10 by a conventional process, the plates 10 and 20 are aligned and attached together to complete the process of fabricating the plasma display.

Thus, this fabrication method forms all of the cathodes at the same time on the rear plate 20 using the compound fiber.

Moreover, the interval between cathodes can be extremely narrow, as described above. For instance, a spacing between cathodes of approximately 55 μm is possible, which is much narrower than the conventional minimum width of 200 μm. In such an embodiment having a 55 μm spacing, the diameter of the wires (which make up the cathodes K) are approximately 25–35 μm. It should be noted that it is desireable to have the largest diameter cathode that space permits, while still avoiding an inter-cathode electrical short.

In the plasma display device of the present invention, a metal such as stainless steel is preferably used as the material of the compound metallic line (which makes up the cathode K), and polyester is preferably used as the thermoplastic synthetic resin.

While the invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A method of fabricating a plasma display panel comprising the steps of:

providing a front and a rear substrate each having an inner surface;

attaching a plurality of parallel anodes to said inner surface of said front substrate;

forming an insulating adhesive layer on said inner surface of said rear substrate;

forming a fiber composite on said insulating adhesive layer, said fiber composite including:

a plurality of parallel cathodes made of a plurality of substantially parallel thin metallic wires, and a plurality of thermoplastic threads made from a thermoplastic synthetic resin that are perpendicular to said cathodes;

melting said thermoplastic threads;

providing a plurality of barriers between said front and rear substrates; and positioning said front and rear substrates opposite each other such that said plurality of parallel cathodes are perpendicular to said plurality of parallel anodes.

2. A method of fabricating a plasma display panel according to claim 1, wherein said thin metallic wires have a circular cross section.

3. A method of fabricating a plasma display panel according to claim 1, wherein said step of forming a fiber composite on said insulating adhesive layer includes a step of intertwining said plurality of parallel cathodes with said plurality of thermoplastic threads.

4. A method of fabricating a plasma display panel according to claim 3, wherein said thin metallic wires have a circular cross section.

5. A method of fabricating a plasma display panel according to claim 1, wherein said insulating adhesive layer is a material having a thermal decomposition temperature higher than a decomposition temperature of said thermoplastic synthetic resin.

6. A method of fabricating a plasma display panel according to claim 5, wherein said thin metallic wires have a circular cross section.

7. A method of fabricating a plasma display panel according to claim 5, wherein said step of forming a fiber composite on said insulating adhesive layer includes a step of intertwining said plurality of parallel cathodes with said plurality of thermoplastic threads.

8. A method of fabricating a plasma display panel according to claim 7, wherein said thin metallic wires have a circular cross section.

* * * * *

UNITED STATES PATENT AND TRADEMARK OFFICE

CERTIFICATE OF CORRECTION

PATENT NO. : 5,458,519

DATED : October 17, 1995

INVENTOR(S) : Seung-woo Lee, et. al.

It is certified that error appears in the above-identified patent and that said Letters Patent is hereby corrected as shown below:

Title page, item [73] Assignee should read -- SAMSUNG ELECTRON DEVICES CO., LTD.--.

Signed and Sealed this

Seventeenth Day of November, 1998

*Attest:*

*Attesting Officer*

BRUCE LEHMAN

*Commissioner of Patents and Trademarks*